US008261778B2

(12) United States Patent
Leroy et al.

(10) Patent No.: US 8,261,778 B2
(45) Date of Patent: Sep. 11, 2012

(54) MOTOR VEHICLE EXHAUST PIPE

(75) Inventors: Vincent Leroy, Montbeliard (FR); Catherine Guyard, Besancon (FR); Sylvain Pellissard, Bavans (FR)

(73) Assignee: Faurecia Systemes d'Echappement, Nanterre (FR)

( * ) Notice: Subject to any disclaimer, the term of this patent is extended or adjusted under 35 U.S.C. 154(b) by 357 days.

(21) Appl. No.: 12/600,546

(22) PCT Filed: May 16, 2008

(86) PCT No.: PCT/FR2008/050851

§ 371 (c)(1), (2), (4) Date: Apr. 21, 2010

(87) PCT Pub. No.: WO2008/142350

PCT Pub. Date: Nov. 27, 2008

(65) Prior Publication Data

US 2010/0200099 A1 Aug. 12, 2010

(30) Foreign Application Priority Data

May 18, 2007 (FR) ..... 07 55130

(51) Int. Cl.
*F16L 9/14* (2006.01)

(52) U.S. Cl. ..... 138/149; 138/114; 138/111; 138/116

(58) Field of Classification Search ..... 138/149, 138/114, 112, 116, 117, 148
See application file for complete search history.

(56) References Cited

U.S. PATENT DOCUMENTS

| | | | | |
|---|---|---|---|---|
| 5,419,127 | A * | 5/1995 | Moore, III | 60/322 |
| 6,134,881 | A | 10/2000 | Strasser et al. | |
| 6,349,542 | B1 * | 2/2002 | Moore, III | 60/323 |
| 6,555,070 | B1 * | 4/2003 | Kruger | 422/179 |
| 6,725,656 | B2 * | 4/2004 | Moore et al. | 60/323 |
| 7,967,032 | B2 * | 6/2011 | Harada et al. | 138/116 |
| 2003/0106311 | A1 | 6/2003 | Moore, III et al. | |
| 2008/0063875 | A1 * | 3/2008 | Robinson et al. | 428/426 |
| 2009/0183502 | A1 * | 7/2009 | Leroy | 60/323 |
| 2009/0301596 | A1 * | 12/2009 | van Oosten | 138/149 |

FOREIGN PATENT DOCUMENTS

| | | |
|---|---|---|
| FR | 2 889 721 | 2/2007 |
| JP | 60-187712 | 9/1985 |
| WO | 2004106705 | 12/2004 |

OTHER PUBLICATIONS

International Search Report dated Nov. 6, 2008, from corresponding PCT application.

* cited by examiner

*Primary Examiner* — Patrick F Brinson
(74) *Attorney, Agent, or Firm* — Young & Thompson

(57) ABSTRACT

A motor vehicle exhaust pipe includes: an outer metal tube; at least one inner tube made from an inorganic matrix composite material and disposed inside the outer metal tube, each inner tube being arranged longitudinally and having a pre-determined longitudinal length and a gap being provided between each inner tube and the outer tube; and elements for maintaining each inner tube in position in relation to the outer tube. The elements for maintaining each inner tube in position in relation to the outer tube include at least one retaining element disposed in the gap between the inner tube and the outer tube, each retaining element exerting a minimum pressure of between $10^{-4}$ MPa and $10^{-1}$ MPa on the inner tube. All of the elements used to maintain one inner tube in position have a cumulative longitudinal length equal to less than half of the longitudinal length of the inner tube.

20 Claims, 4 Drawing Sheets

MOTOR VEHICLE EXHAUST PIPE

The present invention generally relates to motor vehicle exhausts.

More precisely, the invention relates to a motor vehicle exhaust pipe, of the type comprising:

an external metal tube;

at least one internal tube of a composite material having an inorganic matrix which is arranged inside the external metal tube, the or each internal tube extending longitudinally and having a predetermined longitudinal length, a gap being arranged between the or each internal tube and the external tube;

means for fixing the or each internal tube in position relative to the external tube.

Such a pipe is known from FR-2 889 721 which describes how the means for fixing the internal tubes in position relative to the external tube are constituted by a sheet of fibres which fill the gap between the internal tube and the external tube. This sheet is of the type used to fix catalytic converters and particulate filters of exhausts in position.

Such an exhaust pipe is very costly. Furthermore, in particular when the pipe is an exhaust manifold, it is complex to size, taking into account the spatially non-homogeneous behaviour of the composite internal pipe and the metal casing.

In this context, the object of the invention is to provide an exhaust pipe which is less costly and which is easier to size.

To this end, the invention relates to an exhaust pipe of the above-mentioned type, characterised in that the means for fixing each internal tube in position relative to the external tube comprise at least one fixing element which is arranged in the gap between the internal tube and the external tube, the or each fixing element applying to the internal tube a minimum pressure of between $10^{-4}$ MPa and $10^{-1}$ MPa, all the elements contributing to fixing in position the same internal tube having a cumulative longitudinal length of less than half of the longitudinal length of the internal tube.

The exhaust pipe may also have one or more of the features below, taken individually or in accordance with any technically possible combination:

all the elements which contribute to fixing the same internal tube have a cumulative longitudinal length of less than one quarter of the longitudinal length of the internal tube;

the or each fixing element has a longitudinal length of between 5 and 50 millimetres;

the minimum fixing pressure applied by the or each fixing element to the corresponding internal tube is between $10^{-3}$ MPa and $5\times10^{-2}$ MPa;

the or each fixing element has a thickness of between 2 and 10 millimetres;

at least one element for fixing an internal tube is in the form of a closed sleeve which surrounds the internal tube;

at least one element for fixing an internal tube is in the form of an open sleeve which surrounds the internal tube;

the or each fixing element comprises a sheet of ceramic fibres, or comprises a metal trellis or is of plastics material;

the or each fixing element comprises ceramic fibres and an inorganic binding agent, the or each fixing element comprising between 90% and 100% by weight of ceramic fibres;

the ceramic fibres are fibres which are selected from the group comprising silica fibres, aluminium oxide fibres, zirconium fibres, aluminium borosilicate fibres, and admixtures thereof;

the fibres contained in the or each fixing element are an admixture of aluminium oxide fibres and silica fibres in a ratio of 72% and 28%, respectively;

the GBD of the material constituting the or each fixing element is between 0.1 and 0.6;

the density of the material constituting the or each fixing element is between 500 g/m$^2$ and 3000 g/m$^2$;

the friction coefficient of the material which forms the or each element for fixing against the surfaces of the internal tube and external tube is between 0.15 and 0.7; and the exhaust pipe comprises an intermediate tube which is arranged in the gap and which is securely fixed to the external tube, the or each fixing element being interposed between the intermediate tube and the internal tube.

According to a second aspect, the invention relates to an exhaust manifold comprising at least one exhaust pipe as described above.

The exhaust manifold may also have one or more of the features below:

the manifold comprises a plurality of internal tubes which are arranged in the same external tube, the internal tubes having respective upstream portions which are spaced apart from each other and respective downstream end portions which are assembled to form a bundle, the means for fixing the internal tubes comprising at least one fixing element which is dedicated to each internal tube which is arranged in the gap between the upstream portion of the internal tube and the external tube, and an element for fixing the bundle which is arranged in the gap between the bundle and the external tube; and the manifold comprises a plurality of internal tubes which are arranged in the same external tube, the means for fixing the internal tubes comprising at least one fixing element which is provided with a first portion which at least partially surrounds one of the internal tubes, a second portion which at least partially surrounds another of the internal tubes, and an intermediate portion which fixedly joins the first and second portions to each other.

Other features and advantages of the invention will be appreciated from the detailed description which is given below, by way of non-limiting example, with reference to the appended Figures, in which.

Figure 1:
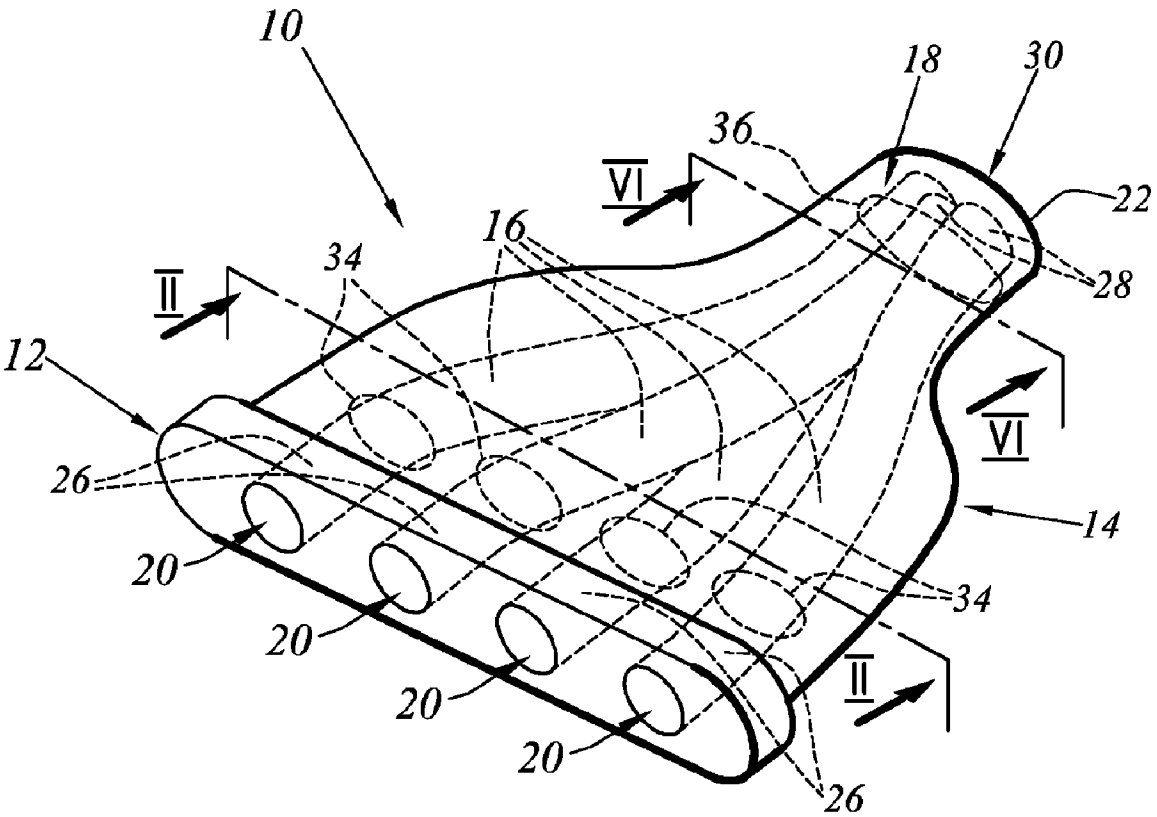
FIG. 1 is a simplified perspective view of an exhaust manifold according to the invention.

The exhaust manifold 10 illustrated in FIG. 1 is intended to be arranged at the outlet of a heat engine, at the inlet of an exhaust line of a motor vehicle. This exhaust line optionally comprises, downstream of the manifold 10, a supercharging (turbo) system and one or more depollution elements which are capable of operating at high temperature.

The manifold 10 comprises an inlet flange 12 which is securely fixed to the engine unit, an external metal tube 14 which is securely fixed to the inlet flange 12, internal tubes 16 which are composed of composite material having an inorganic matrix and which are arranged inside the external tube 14, and means 18 for fixing the internal tubes 16 in position relative to the external tube 14. The manifold 10 comprises, for example, four internal tubes 16.

The flange 12 is a thick metal component comprising four exhaust gas inlets 20 which are aligned and regularly spaced apart. These inlets 20 are intended to be arranged so as to be coincident with the outlet holes of the four cylinders of the heat engine.

The external tube 14 defines in an upstream direction an inlet opening which is pressed in a fluid-tight manner against the flange 12 and which surrounds the inlets 20. It also defines, opposite the flange 12, an outlet opening 22 in the downstream direction of the exhaust line. In the embodiment of FIG. 1, the external tube 14 is formed by two crimped metal half-shells which are joined together. The external tube is formed by a metal wall which has a thickness of between 0.5 mm and 3 mm. It is typically made of steel, aluminium or titanium.

Figure 6:
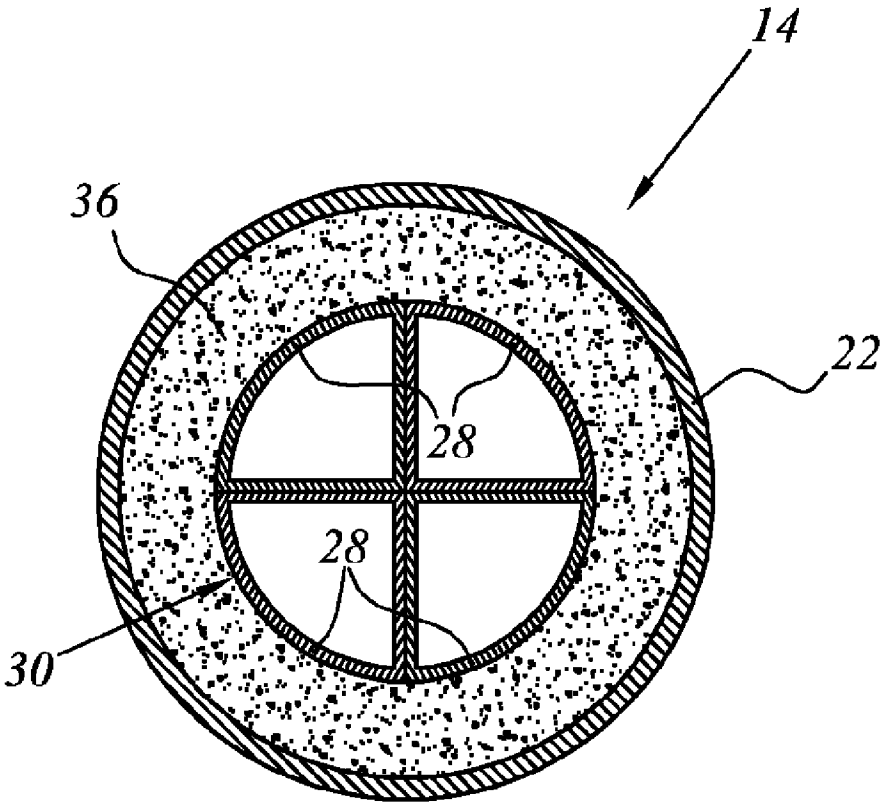
FIG. 6 is a sectioned view of the manifold of FIG. 1, taken in accordance with the arrows VI of FIG. 1.

Each internal tube 16 is arranged inside the external tube so that a gap 24 is provided between the internal tube 16 and the external tube 14, over the entire longitudinal length of the internal tube 16. Each tube 16 extends from one of the inlets 20 as far as the outlet opening 22. In this manner, each inlet 20 opens in an internal tube 16. The upstream portions 26 of the internal tubes are spaced apart from each other. The upstream portions in this instance are intended to refer to the portions of the internal tubes which extend from the inlets 20. However, the downstream end portions 28 of the internal tubes 16 are joined together to form a bundle 30. The end portions 28 are pressed against each other, substantially parallel with each other, in the bundle 30. Each internal tube 16 has, along the upstream portion 26 thereof, a substantially circular cross-section, and a cross-section in the form of a quarter circle in the downstream end portion 28. As illustrated in FIG. 6, the portions 28 can be arranged in such a manner that the bundle 30 has a circular cross-section. The bundle 30 is engaged in the opening 22 and opens in the direction of the downstream portion of the exhaust line.

Figure 2:
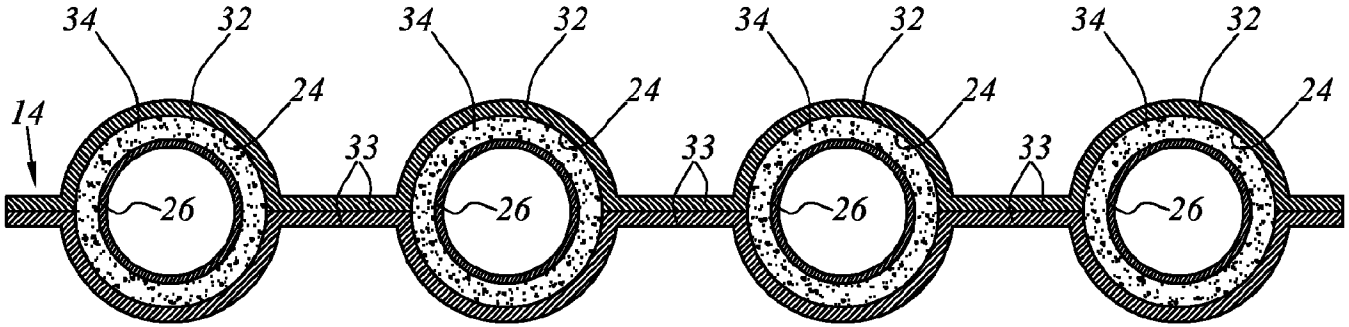
FIG. 2 is a sectioned view of the manifold of FIG. 1, taken in accordance with the incidence of the arrows II of FIG. 1, for a first embodiment of the invention.

According to a first embodiment of the invention, illustrated in FIG. 2, the external tube 14 defines a tubular portion 32 around each upstream portion 26. Each tubular portion 32 is substantially cylindrical and completely surrounds the corresponding upstream portion 26. The portion 32 is coaxial relative to the corresponding portion 26. Along all the upstream portions 26, the tubular portions practically do not communicate with each other. However, the tubular portions 32 open one into the other in the direction towards the downstream end portions 28 so as to form the opening 22. The tubular portions 32 are fixedly joined to each other by means of webs 33 of the two half-shells which are pressed against each other.

The internal tube 16 is a tube which is formed from a composite material having an inorganic matrix, in particular ceramic material. Examples of a composite material having an inorganic matrix which can allow the formation of the internal tube 16 are set out in the patent applications U.S. Pat. No. 6,134,881 and WO-2004/106705. These materials are formed by the association of a matrix constituted by at least one inorganic polymer, preferably of the geopolymer type, based on an aluminosilicate. This matrix is reinforced by fibres, in particular based on silicon carbide (SiC), carbon or silicon dioxide ($SiO_2$), or a stainless metal wire which withstands temperatures equal to or greater than 600° C. (stainless steel, Inconel, . . . ). Preferably, the internal tube 16 is formed by a wall which has a thickness of less than 2 mm.

The means 18 for fixing the internal tubes 16 in position relative to the external tube 14, in the first embodiment of the invention, comprise five fixing sleeves which are arranged in the gap 24 between the internal tubes 16 and the external tube 14. Four of the sleeves, designated 34, are each arranged around the upstream portion 26 of one of the internal tubes. The fifth sleeve, designated 36, is arranged around the bundle 30.

As illustrated in FIG. 2, each sleeve 34 is in abutment, with a radially inner face, against the corresponding internal tube 16 and, with a radially outer face, against the external tube 14, more precisely against the corresponding tubular portion 32 of the external tube. The sleeve 36 is in abutment, with a radially inner face, against the bundle 30 and, with a radially outer face, against the opening 22.

The sleeves 34 and 36 are closed over on themselves. They have a thickness of between 2 mm and 10 mm, preferably of between 3 mm and 6 mm. They each have a longitudinal length, that is to say, parallel with the axis of the tube on which they are installed, of between 5 mm and 50 mm, preferably of between 15 mm and 40 mm.

The sleeves 34 and 36 may comprise a sheet of ceramic fibres or may comprise a metal trellis or may be constituted by a plastics material.

Typically, the sleeves 34 and 36 are formed from a sheet of ceramic fibres, in particular long ceramic fibres which are preferably associated with an organic and/or inorganic binding agent.

The organic binding agent is advantageous only when the sleeve is positioned around the internal tube. It is consumed during the first temperature rise of the exhaust pipe on the vehicle. This binding agent constitutes from 0% to 15% by mass of the new sleeve. The inorganic binding agent is used when it is necessary to provide better cohesion between the fibres during the operation of the vehicle and must therefore not be consumed. This binding agent constitutes from 0% to 10% by mass of the sleeve exclusive of the organic binding agent. In this manner, in an operational configuration, the ceramic fibres constitute from 90% to 100% by weight of the sleeve, any remainder being the inorganic binding agent.

The ceramic fibres of the sleeve are selected from the group comprising silica fibres, aluminium oxide fibres, zirconium fibres, aluminium borosilicate fibres and an admixture thereof. The sheets may be needled which allows their long-term strength to be improved.

Preferably, the fibres used are fibres of mullite which associate aluminium oxide and silicon dioxide in a ratio of 72% and 28%, respectively. The density of the material which constitutes the sleeve is between 500 $g/m^2$ and 3000 $g/m^2$.

The fixing sleeves 34, 36 must fix the internal tubes 16 in the external tube 14 regardless of the operating conditions.

In accordance with the characteristics of the ceramic internal tubes and the nature of the fixing sleeves (mass, contact surface-area with the fixing layer), the maximum acceleration to which they are subjected and the maximum flow and pressure of the exhaust gases, the minimum pressure to be applied in order to fix the internal tubes in the metal tube is determined. This minimum pressure takes into account, in addition to the stresses mentioned above, a specific corrective factor of the behaviour of the ceramic internal tube and the fixing sleeves during operation. A friction coefficient is involved in this corrective factor. In accordance with the material which constitutes the internal and external tubes, the material which constitutes the fixing sleeves is selected so that the friction coefficient of the sleeves against the surfaces of the internal and external tubes is between 0.15 and 0.7. The minimum fixing pressure applied by each sleeve 34, 36 to the internal tube 16 or to the bundle 30 is between $10^{-4}$ and $10^{-1}$ MPa and preferably between $10^{-3}$ MPa and $5\times10^{-2}$ MPa.

The value of $10^{-3}$ MPa corresponds to an internal tube of 100 grammes which has a contact surface-area of 40 $dm^2$ with the fixing sleeves 34 and 36 and which is subject to an acceleration of 10 g and a pressure drop of 100 Pa. This pressure drop is brought about by the friction of the gases against the wall of the internal tube. The value of $5\times10^{-2}$ MPa corresponds to an internal tube of 200 grammes which has a contact surface-area of 20 $dm^2$ with the fixing sleeves 34 and 36 and which is subject to an acceleration of 40 g and a pressure drop of 250 Pa.

It has been found that, in accordance with the type of sheet selected to constitute the fixing sleeves 34, 36, it is necessary, on the one hand, to prevent the destruction of the fibres which constitute the sheet and, on the other hand, to prevent damage to the internal tube which is of a composite material having an inorganic matrix. To that end, it is important not to exceed a specific pressure applied to the internal tube and therefore a specific compression of the sheet: this maximum pressure is between 0.1 and 1 MPa and preferably between 0.3 and 0.7 MPa.

The GBD (Gap Bulk Density) is the ratio between the density in kilogrammes per square metre of the sheet selected to constitute the fixing sleeves and the clearance in millimetres between the external and internal tubes. The density is a specific characteristic of the sheet. In the context of the invention, the value of the clearance between the external and internal tubes is dictated in particular by the shape restrictions of the exhaust line element. The GBD range which can be used is between 0.1 and 0.6. The minimum value is given to prevent damage to the fibres owing to vibrations, the maximum value is given to prevent damage to the fibres owing to compression.

The relationship between the GBD and the pressure P applied to the internal tube by each fixing sleeve is given, for a sheet which is constituted by long ceramic fibres, by an equation of the type $P=A\cdot(GBD)^3+B\cdot(GBD)^2+C(GBD)+D$.

When selecting a sheet of given density which is intended to keep the internal tube separate from the external tube with a given clearance, it is ensured that the pressure applied will be greater than the minimum fixing pressure and less than the maximum pressure withstood by the fibres and the internal tube. To this end, it must also be taken into account that, during use, the clearance between the internal tube and external tube may vary by 1 mm more or less owing to the differential expansion between the internal tube and the external tube.

In this manner, for a fixing sleeve 34, 36 formed from a sheet which is constituted by long ceramic fibres having a density of 900 $g/m^2$ and which is positioned between an internal tube (composite pipe of 200 grammes having a contact surface-area of 20 $dm^2$ with the fixing sheet and subject to an acceleration of 40 g) and an external tube which are separated by a minimum clearance of 3 mm, the GBD is 0.3. The fixing pressure applied by the sleeve to the internal tube of a composite material having a ceramic matrix is, for the type of sheet selected, 0.2 MPa. This GBD of 0.3 is within the recommended GBD range. This pressure is greater than the minimum fixing pressure calculated for this application ($5\times10^{-2}$ MPa) and is less than the mechanical strength of the internal tube.

The maximum clearance for this same application is 4.25 mm, corresponding to a GBD of 0.22 and a fixing pressure of $6\times10^{-2}$ MPa. The GBD remains in the range of use of the sheet and the pressure produced remains greater than the minimum fixing pressure.

In this manner, each internal tube 16 is held in position relative to the external tube 14 both by the sleeve 34 which is arranged around the upstream portion thereof and also by the sleeve 36 which is arranged around the bundle 30. In a variant, it is possible to provide other fixing sleeves of the same type around the upstream portion 26 of the internal tube. The gap 24 is filled with a thermal insulating material of conventional type in all the zones which are not occupied by the fixing sleeves. This material is, for example, the insulating material sold under the name of HKO by Hakotherm or the one sold under the name Superwools by Thermal Ceramics. It is significantly less expensive than the material used to constitute the fixing sleeves 34 and 36. In order to provide a compromise between the efficacy of fixing the internal tubes in position and the cost of this function, the respective longitudinal lengths of the fixing sleeves of each internal tube will preferably be selected so that these cumulative longitudinal lengths will be less than half of the longitudinal length of the internal tube and preferably less than a quarter of the longitudinal length of the internal tube.

Figure 3:
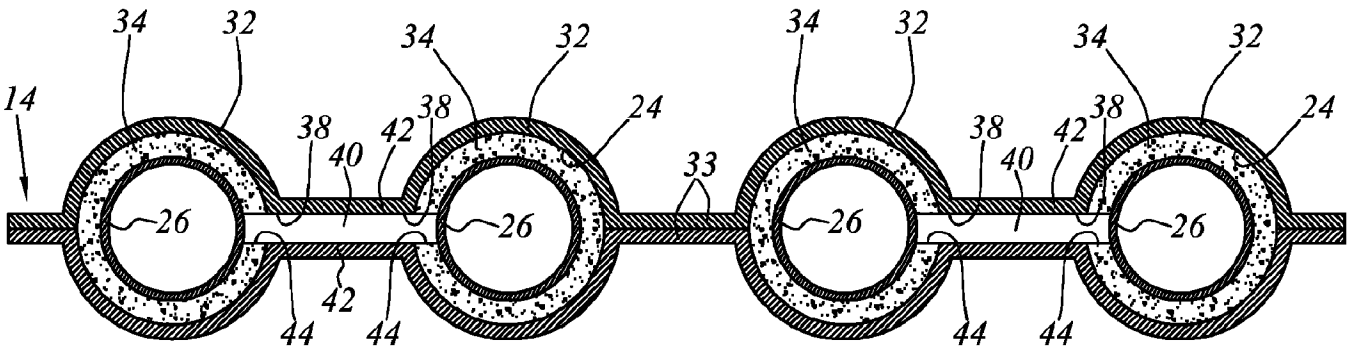
FIG. 3 is a sectioned view similar to that of FIG. 2 for a second embodiment of the invention.

A second construction variant is illustrated in FIG. 3. Only the points by which this second embodiment of the invention differs from the first will be described in this instance. Elements which are similar or which have the same function will have the same reference numerals as in the first embodiment.

As illustrated in FIG. 3, in this embodiment, the tubular portions 32 of the external tube which surround the upstream portions 26 of the internal tubes communicate in pairs. Each tubular portion 32 surrounds the corresponding portion 26 over approximately 340° and is open over an angular sector e of approximately 20° which is directed towards an adjacent tubular portion 32. The open zones 38 of the two adjacent tubular portions 32 communicate via a channel 40 which extends substantially over the entire length of the tubular portions 32. The channel 40 is delimited by substantially planar corresponding portions 42, which are arranged so as to face each other, of the two half-shells forming the external tube 14.

In this instance, the sleeves 34 are no longer of the type which is closed over on itself but instead are of the open type. Each sleeve 34 surrounds the internal tube 16 over approximately 340°. It has an opening 44 over an angular sector of approximately 20°, over the entire longitudinal length of the sleeve. The opening 44 of the sleeve is positioned so as to be coincident with the opening 38 of the corresponding tubular portion 32. In this manner, the sleeve 34 is interposed between the tubular portion 32 of the external tube and the internal tube over the entire periphery of the tubular portion 32, with the exception of the sector in which the tubular portion is open in the direction towards the adjacent tubular portion.

Figure 4:
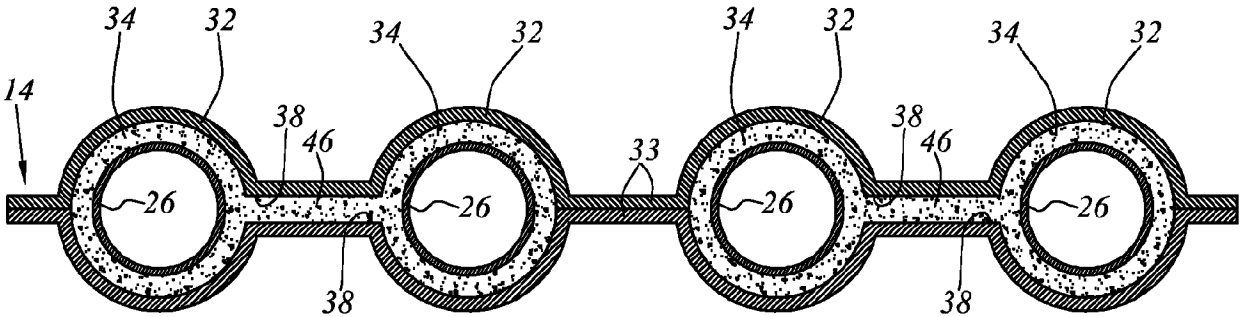
FIG. 4 is a sectioned view similar to that of FIG. 2 for a third embodiment of the invention.

A third embodiment of the invention is illustrated in FIG. 4. Only the differences with respect to the second embodiment of the invention will be set out below. Elements which are similar or which provide the same function will be referred to with the same reference numerals as in the second embodiment.

As illustrated in FIG. 4, the tubular portions 32 of the outer casing communicate in pairs, as in the second embodiment of the invention. The fixing sleeves 34 of the internal tubes arranged in the two communicating tubular portions are closed and completely surround the two internal tubes. Furthermore, the two sleeves 34 are fixedly joined to each other with an intermediate portion 46 which extends through the space 40. The intermediate portion 46 is constituted by the same material as the sleeves 34.

Figure 5:
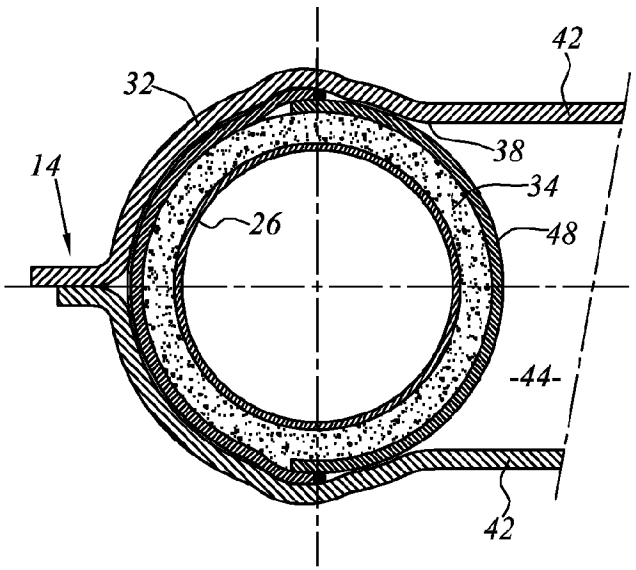
FIG. 5 is a partial sectioned view of a fourth embodiment of the invention.

A fourth embodiment of the invention is illustrated in FIG. 5. Only the points by which this fourth embodiment differs from the second embodiment will be described below. Elements which are similar or which provide the same function as in the second embodiment will have the same reference numerals.

As in the second embodiment, the tubular portions 32 of the external tube 14 communicate in pairs. In this manner, each tubular portion 32 surrounds the corresponding internal tube over a portion of the periphery thereof and is open in the direction towards the adjacent tube over an angular sector of approximately 120°. Owing to the magnitude of this opening, an intermediate metal tube 48 is arranged in the gap 24 and is securely fixed to the external tube 14, for example, by means of welding. The intermediate tube 48 completely surrounds the internal tube 16. It is, for example, constituted by two half-shells having a semi-circular cross-section which are crimped or welded to each other. The intermediate tube 48 is typically constituted by the same material as the external tube 14. It has, for example, a thickness of between 0.5 mm and 3 mm. In this instance, the fixing sleeves 34 are of the closed type and are each compressed between an internal tube 16 and an intermediate tube 48. The intermediate tube 48 extends substantially over the entire length of the corresponding sleeve 34. It consequently has a length of between 5 mm and 50 mm.

Such an intermediate tube is used when the tubular portion 32 surrounds the internal tube 16 over less than 75% of its periphery.

The exhaust pipe described above has several advantages.

Owing to the fact that the means for fixing the internal tubes in position relative to the external tube comprise at least one fixing element arranged in the gap between these tubes and applying a minimum pressure of between $10^{-4}$ MPa and $10^{-1}$ MPa, and that the cumulative longitudinal length of all the elements contributing to fixing the same tube in position is less than half of the longitudinal length of the tube, the exhaust pipe is particularly inexpensive. The fixing elements which are produced from a more costly material extend over only a small proportion of the longitudinal length of the internal tube, the gap being filled over the entire remainder of the length of the tube by a simple thermal insulation material with no fixing function which is much less costly than the material used for the fixing elements.

Furthermore, these elements are sleeves which have a very simple shape. They may be very easily integrated in the external tube, without requiring long and complex development.

Furthermore, the fixing force of the internal tubes may be adjusted, inter alia, by selecting the number of fixing sleeves arranged over the length of each internal tube. This degree of freedom is added to those described above in the paragraphs relating to the selection of the dimensions and the material of the sleeves.

The use of the sleeves allows the internal tubes of ceramic material to be fixed in position relative to the external metal tube in an extremely effective manner.

The exhaust pipe described above may have a number of variants.

The number of fixing sleeves for each internal tube may be different from two and may be one, three or more.

The tubular portions 32 of the external tube 14 may be completely independent of each other, and may be joined together only at the downstream ends thereof to form the opening 22.

The manifold may have any type of geometry. It may comprise less than four inlets or, in contrast, more than four inlets. It may comprise more or less than four internal tubes. The internal tubes may open into each other in the region of the downstream opening 22, or upstream of this downstream opening. They may also not open into each other. The internal tubes may have any type of cross-section. In this manner, the upstream portions of these internal tubes may not have circular cross-sections. The end portions of these internal tubes may not have a cross-section in the form of a quarter circle.

Furthermore, the exhaust pipe is not necessarily an exhaust manifold. It may also be a connection pipe between two elements of the exhaust line, for example, between the exhaust manifold and a catalytic processing assembly for the exhaust gases. In this instance, the exhaust line typically comprises a single internal tube, and two fixing sleeves which are arranged at the two opposing ends of the internal tube.

The invention claimed is:

1. Motor vehicle exhaust pipe, the pipe (10) comprising:

an external metal tube (14);

at least one internal tube (16) of a composite material having an inorganic matrix which is arranged inside the external metal tube (14), the or each internal tube (16) extending longitudinally and having a predetermined longitudinal length, a gap (24) being arranged between the or each internal tube (16) and the external tube (14);

means (18) for fixing the or each internal tube (16) in position relative to the external tube (14), wherein the means (18) for fixing each internal tube (16) in position relative to the external tube (14) comprise at least one fixing element (34, 36) which is arranged in the gap (24) between the internal tube (16) and the external tube (14), the or each fixing element (34, 36) applying to the internal tube (16) a minimum pressure of between $10^{-4}$ MPa and $10^{-4}$ MPa, all the elements (34, 36) contributing to fixing in position the same internal tube (16) having a cumulative longitudinal length of less than half of the longitudinal length of the internal tube (16).

2. Exhaust pipe according to claim 1, wherein all the elements (34, 36) which contribute to fixing the same internal tube (16) have a cumulative longitudinal length of less than one quarter of the longitudinal length of the internal tube (16).

3. Exhaust pipe according to claim 1, wherein the or each fixing element (34, 36) has a longitudinal length of between 5 and 50 millimeters.

4. Exhaust pipe according to claim 1, wherein the minimum fixing pressure applied by the or each fixing element (34, 36) to the corresponding internal tube (16) is between $10^{-3}$ MPa and $5\times10^{-2}$ MPa.

5. Exhaust pipe according to claim 1, wherein the or each fixing element (34, 36) has a thickness of between 2 and 10 millimeters.

6. Exhaust pipe according to claim 1, wherein at least one element (34, 36) for fixing an internal tube (16) is in the form of a closed sleeve which surrounds the internal tube (16).

7. Exhaust pipe according to claim 1, wherein at least one element (34, 36) for fixing an internal tube (16) is in the form of an open sleeve which surrounds the internal tube (16).

8. Exhaust pipe according to claim 1, wherein the or each fixing element (34, 36) comprises a sheet of ceramic fibres, or comprises a metal trellis or is of plastics material.

9. Exhaust pipe according to claim 1, wherein the or each fixing element (34, 36) comprises ceramic fibres and an inorganic binding agent, the or each fixing element (34, 36) comprising between 90% and 100% by weight of ceramic fibres.

10. Exhaust pipe according to claim 9, wherein the ceramic fibres are fibres which are selected from the group comprising silica fibres, aluminium oxide fibres, zirconium fibres, aluminium borosilicate fibres, and admixtures thereof.

11. Exhaust pipe according to claim 10, wherein the fibres contained in the or each fixing element (34, 36) are an admixture of aluminium oxide fibres and silica fibres in a ratio of 72% and 28%, respectively.

12. Exhaust pipe according to claim 1, wherein the GBD of the material constituting the or each fixing element (34, 36) is between 0.1 and 0.6.

13. Exhaust pipe according to claim 1, wherein the density of the material constituting the or each fixing element (34, 36) is between 500 $g/m^2$ and 3000 $g/m^2$.

14. Exhaust pipe according to claim 1, wherein the friction coefficient of the material which forms the or each element (34, 36) for fixing against the surfaces of the internal tube (16) and external tube (14) is between 0.15 and 0.7.

15. Exhaust pipe according to claim 1, wherein it comprises an intermediate tube (48) which is arranged in the gap (24) and which is securely fixed to the external tube (14), the or each fixing element (34) being interposed between the intermediate tube (48) and the internal tube (16).

16. Exhaust manifold comprising at least one exhaust pipe according to claim 1.

17. Exhaust manifold according to claim 16, wherein it comprises a plurality of internal tubes (16) which are arranged in the same external tube (14), the internal tubes (16) having respective upstream portions (26) which are spaced apart from each other and respective downstream end portions (28) which are assembled to form a bundle (30), the means (18) for fixing the internal tubes (16) comprising at least one fixing element (34) which is dedicated to each internal tube (16) which is arranged in the gap (24) between the upstream portion (26) of the internal tube (16) and the external tube (14), and an element (36) for fixing the bundle (30) which is arranged in the gap (24) between the bundle (30) and the external tube (14).

18. Exhaust manifold according to claim 16, wherein it comprises a plurality of internal tubes (16) which are arranged in the same external tube (14), the means (18) for fixing the internal tubes comprising at least one fixing element which is provided with a first portion (34) which at least partially surrounds one of the internal tubes (16), a second portion (34) which at least partially surrounds another of the internal tubes (16), and an intermediate portion (46) which fixedly joins the first and second portions (34) to each other.

19. Exhaust pipe according to claim 2, wherein the or each fixing element (34, 36) has a longitudinal length of between 5 and 50 millimeters.

20. Exhaust manifold according to claim 17, wherein it comprises a plurality of internal tubes (16) which are arranged in the same external tube (14), the means (18) for fixing the internal tubes comprising at least one fixing element which is provided with a first portion (34) which at least partially surrounds one of the internal tubes (16), a second portion (34) which at least partially surrounds another of the internal tubes (16), and an intermediate portion (46) which fixedly joins the first and second portions (34) to each other.

* * * * *